US009969515B1

(12) United States Patent
Formo et al.

(10) Patent No.: US 9,969,515 B1
(45) Date of Patent: May 15, 2018

(54) PASS-THROUGH SYSTEM FOR AN AUTOMATED WRAPPING MACHINE

(71) Applicant: Formost Fuji Corporation, Woodinville, WA (US)

(72) Inventors: Norman Paul Formo, Woodinville, WA (US); David Terry, Kirkland, WA (US)

(73) Assignee: Formost Fuji Corporation, Woodinville, WA (US)

( * ) Notice: Subject to any disclaimer, the term of this patent is extended or adjusted under 35 U.S.C. 154(b) by 439 days.

(21) Appl. No.: 14/673,432

(22) Filed: Mar. 30, 2015

Related U.S. Application Data

(60) Provisional application No. 61/972,139, filed on Mar. 28, 2014.

(51) Int. Cl.

| | |
|---|---|
| ***B65B 59/00*** | (2006.01) |
| ***B65B 9/067*** | (2012.01) |
| ***B65B 35/30*** | (2006.01) |
| ***B65B 41/12*** | (2006.01) |
| ***B65B 35/40*** | (2006.01) |

(52) U.S. Cl.
CPC ..... *B65B 59/005* (2013.01); *B65B 9/067* (2013.01); *B65B 35/30* (2013.01); *B65B 35/40* (2013.01); *B65B 41/12* (2013.01)

(58) Field of Classification Search
CPC ..... B65B 41/12; B65B 35/40; B65B 35/30; B65B 9/067; B65B 59/005; B65B 9/06; B65B 59/00; B65B 11/00; B65B 2009/063
USPC ..... 426/124; 53/450, 550, 201, 389.1, 203, 53/461, 393
See application file for complete search history.

(56) References Cited

U.S. PATENT DOCUMENTS

| | | | | |
|---|---|---|---|---|
| 6,858,242 | B1 | 2/2005 | Formo | |
| 7,325,374 | B2 * | 2/2008 | Chrisman | B65B 9/02 53/203 |
| 2009/0229228 | A1 * | 9/2009 | Sambugaro | B65B 9/06 53/550 |

* cited by examiner

*Primary Examiner* — Robert Long
*Assistant Examiner* — Xavier A Madison
(74) *Attorney, Agent, or Firm* — Christensen O'Connor Johnson Kindness PLLC

(57) ABSTRACT

In an automatic horizontal wrapping machine for applying a wrapper to consecutive bread loaves moved along a feed path through the machine, changeover to operation allowing the loaves to pass through the machine without being wrapped is accomplished by: disabling a feed for wrapping material; shifting and maintaining a wrapping material forming box out of the feed path; installing a slide deck defining the bottom of the feed path; providing a transfer component to move loaves along the feed path by sliding on the deck separate and apart from and independent of the transfer mechanism used by the machine when wrapping; and disabling a cutter-sealing component sufficiently so as not to interfere with passage of bread loaves past the cutter-sealer; to allow the bread loaves to pass through the machine along the feed path without being wrapped.

9 Claims, 10 Drawing Sheets

PASS-THROUGH SYSTEM FOR AN AUTOMATED WRAPPING MACHINE

CROSS-REFERENCES TO RELATED APPLICATION

This application claims the benefit of Provisional Application No. 61/972,139, filed Mar. 28, 2014; the entire disclosure of said application is hereby expressly incorporated by reference herein.

BACKGROUND

The present invention relates to an improved bread wrapping machine and a method of use of the machine.

In a known system for high-speed packaging of bread, loaves are conveyed from an oven to packaging lines. Automatic gates and transfer mechanism can direct the loaves to side-by-side packaging lines. For a premium package, each line can include a slicer with an outfeed discharge conveyor leading to an automatic horizontal wrapper. The wrapper applies a snug and sealed wrapping, which can help maintain the bread slices in an aesthetically pleasing and reasonably uniform loaf. From the wrapper, the loaves are transferred to an automatic bagger. The bag supplied at the bagger is typically much looser than the inner wrapper. The double package enhances the appearance of a premium product. From the bagger the loaves can be conveyed to other transfer equipment, such as loaders and stackers. At least the slicer, wrapper, and bagger can have the same horizontal, linear feed path, and side-by-side lines can be closely spaced together to save room on the factory floor.

For the same or a different bread product, loaves from a slicer can be conveyed directly to a bagger, without an inner wrapper. The slicer and bagger can be the same as the corresponding components used in the premium package described above. If it is desired to use the same slicer and bagger, the sliced loaves must bypass the wrapping machine. One proposed system uses a "portable" wrapping machine on casters, which can be disconnected and moved laterally off the feed line. A separate transfer conveyor is inserted in the feed line to move the sliced loaves along the path to the bagger. Another possibility is to route the bread around the wrapping machine by separate conveyors, gates, and other transfer mechanism. These systems have the advantage of being optionally used for "single-bagged" or "wrapped and bagged" product, but require more floor space and routing equipment.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with the present invention, changeover of an automatic horizontal wrapping machine from operating in a first configuration to apply a wrapper to consecutive bread loaves moved along a feed path through the machine to a second configuration allowing the loaves to pass through the machine without being wrapped is accomplished by: disabling a feed for wrapping material; shifting and maintaining a wrapping material forming box out of the feed path; and providing a transfer component to move loaves along the feed path separate and apart from and independent of the transfer mechanism used to move the loaves when being wrapped. In one embodiment of the invention, providing the transfer component for pass-through operation includes installing a slide deck having a smooth upper surface forming a bottom surface of the feed path, and moving pusher bars extending transversely of the feed path in a continuous loop above the slide deck, such loop having an upper run in which the bars are moved in an upstream direction at a height above the loaves so as not to interfere with downstream movement of the loaves along the feed path and a lower run above the deck but in the feed path at a height to engage the trailing sides of the loaves and move the loaves along the feed path.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The present invention provides an improved horizontal bread wrapping machine system that can be used in a traditional wrapping operation but which can also be quickly and easily converted to allow bread loaves to pass through along the feed line without being wrapped.

Figure 1:
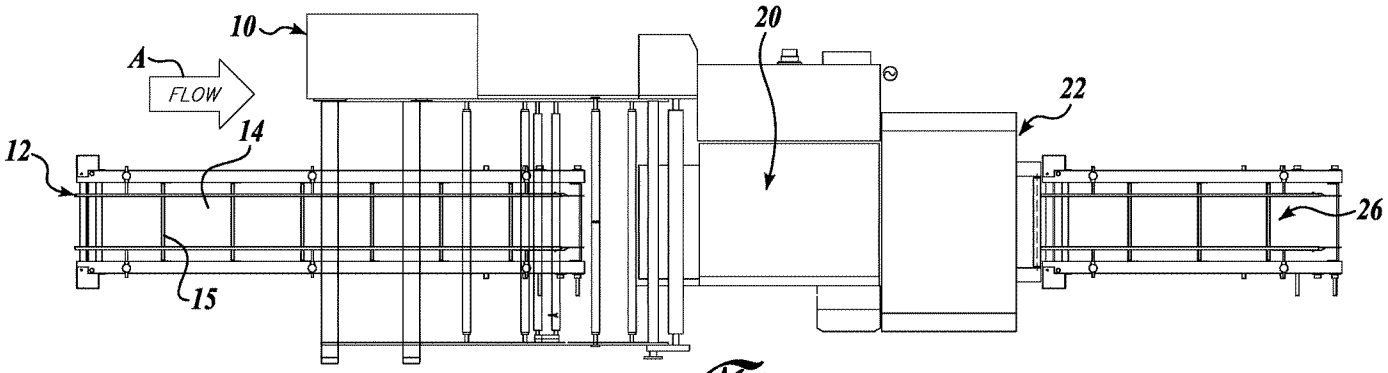
Fig. 1. (PRIOR ART)
FIG. 1 (prior art) is a diagrammatic top plan of a known bread wrapping machine, and FIG. 2 (prior art) is a diagrammatic side elevation thereof.
Figure 2:
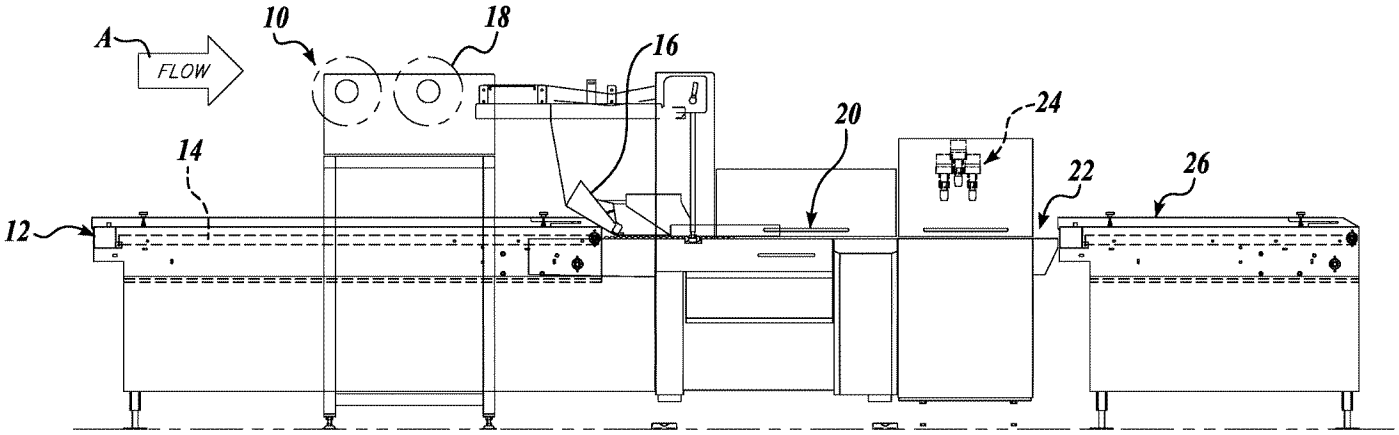
Fig. 2. (PRIOR ART)

More specifically, a known bread wrapping machine 10 is illustrated diagrammatically in FIG. 1 and FIG. 2. The direction of movement of bread loaves through the machine is represented by the arrows A. At the infeed end 12, a conveyor 14 moves the bread loaves transversely (ends at the sides) toward a stationary forming box 16 (best seen in FIG. 2). Conveyor 14 preferably has transverse flights 15 (seen in FIG. 1) to engage against the trailing edges of the loaves. Wrapping material is provided on upper feed rolls 18 (best represented in FIG. 2) and is routed down to the forming box 16.

Figure 3:
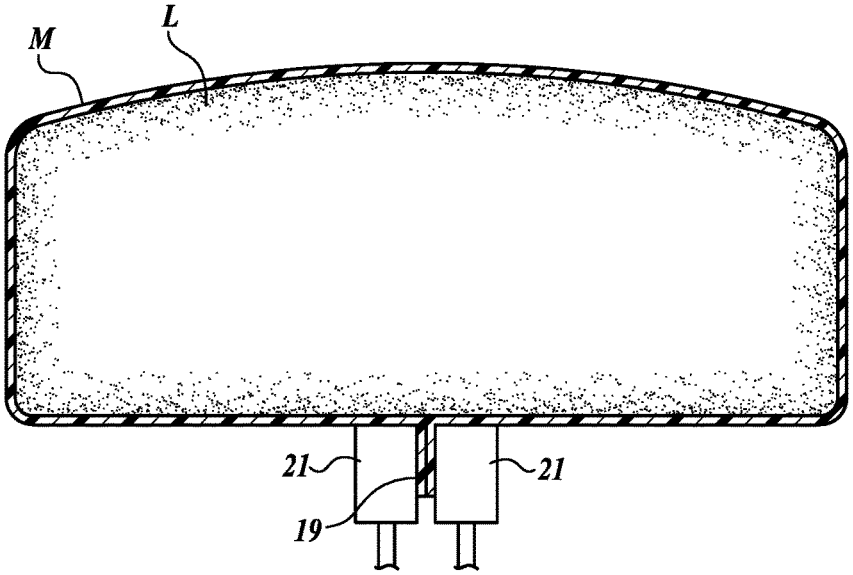
FIG. 3 (prior art) is a representation of a bread loaf at one stage of a wrapping operation by the machine of FIG. 1 and FIG. 2 as the loaf is moved through a central portion of the machine.

Sliced loaves are moved by the flighted conveyor 14 toward the forming box 16 with the wrapping material in position to be draped over the bread. As a loaf is moved through the forming box, draping of the wrapping material continues. The forming box is shaped to tuck the wrapping material along the ends of the loaf as it moves through the box, and under the bottom of the loaf, forming a tube with a vertical seam at the bottom. As represented in FIG. 3, at this stage the bread loaves are encircled by a tube of the wrapping material M and the seam is in the form of a downward extending flap 19. The flighted infeed conveyor 14 ends at the forming box 16. From there the bread loaves are conveyed along the feed path by the flap 19 of the wrapper tube being pulled along, such as between pinch rollers 21 in the central area of the feed path (designated 20 in FIG. 1 and FIG. 2), as the wrapper tube slides toward the outfeed end 22 of the wrapping machine, the pinch rollers 21, which engage the downward extending flap 19 of the wrapping material M being an example of a bottom transfer mechanism.

Returning to FIG. 2, the travel of each loaf continues to a reciprocating sealing and cutting unit 24, which is timed to plunge downward between adjacent loaves (multiple positions of the unit 24 are shown in FIG. 2), follow the feed path for a short distance while sealing and cutting is achieved, then raise up and back over the loaf for plunging back down at the trailing side to seal the trailing side of the wrapper. The leading side of the wrapper of the next loaf is sealed at the same time. The individual wrapped loaves are conveyed from the sealing area onto a flighted outfeed transfer conveyer 26, which can convey the loaves to an automatic bagger.

Figure 4:
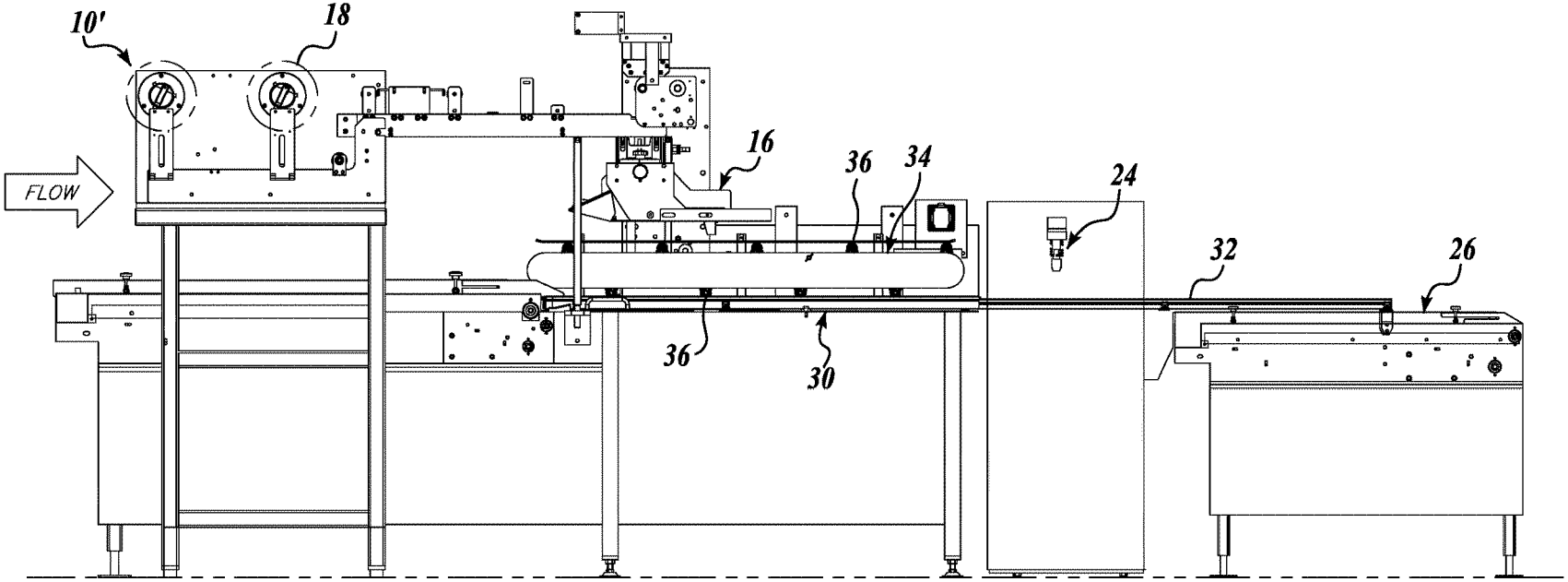
FIG. 4 is a diagrammatic side elevation of a bread wrapping machine modified in accordance with the present invention.
Figure 5:
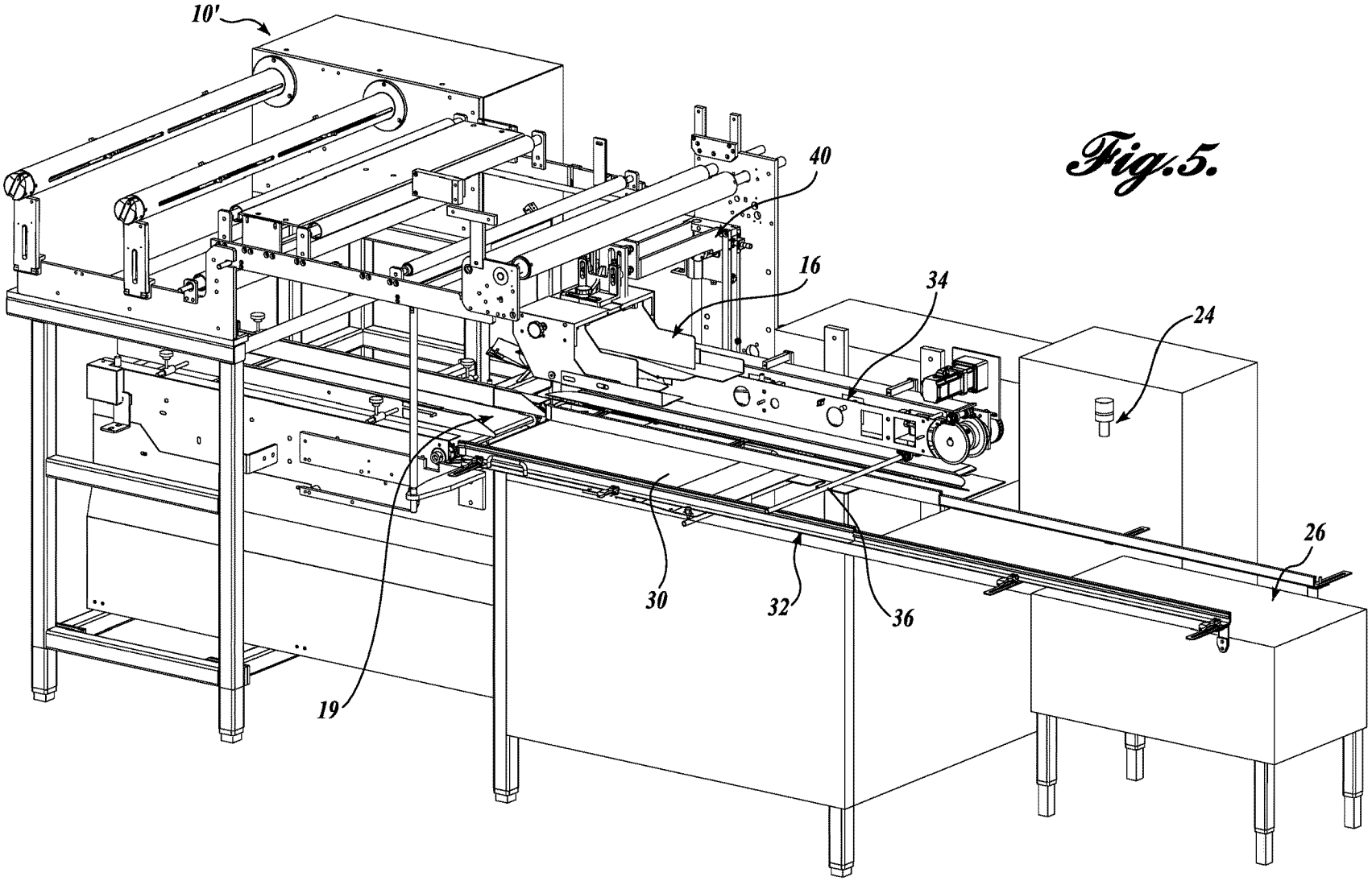
FIG. 5 is a diagrammatic perspective thereof.

With reference to FIG. 4 and FIG. 5, the present invention provides a system for allowing sliced loaves to pass through the modified wrapping machine 10' without being wrapped, so that the loaves can be transferred directly to a bagger, thereby eliminating the need for making the wrapper portable or rerouting the line from the slicer to the bagger when no inner wrapper is desired. Three primary modifications are made to the conventional wrapping machine, and quick changeover from a wrapping operation to a pass-through operation is easily achieved. First, the forming box 16 can be raised sufficiently that the bread loaves may pass under it (described below with reference to FIG. 6). Second, a transfer deck 30 and guiderail system 32 is provided so that the loaves can be slid along the feed path without interference by the wrapper pinch rolls and other parts (described below with reference to FIGS. 7-9). Third, a timed transfer assembly 34 (described below with reference to FIGS. 10-12) is provided with push bars 36 for engaging behind the loaves and sliding them along the deck 30 to the separate, conventional transfer conveyor 26 leading to the bagger. Then, with the wrapper material infeed mechanism disabled (turned off), and the sealing unit 24 turned off and locked in its up position where it will not contact loaves passing beneath it, the push bars will engage the unwrapped loaves as they approach the raised forming box 16 and slide the loaves along the deck 30 for introduction onto the outfeed conveyor 26.

Figure 6:
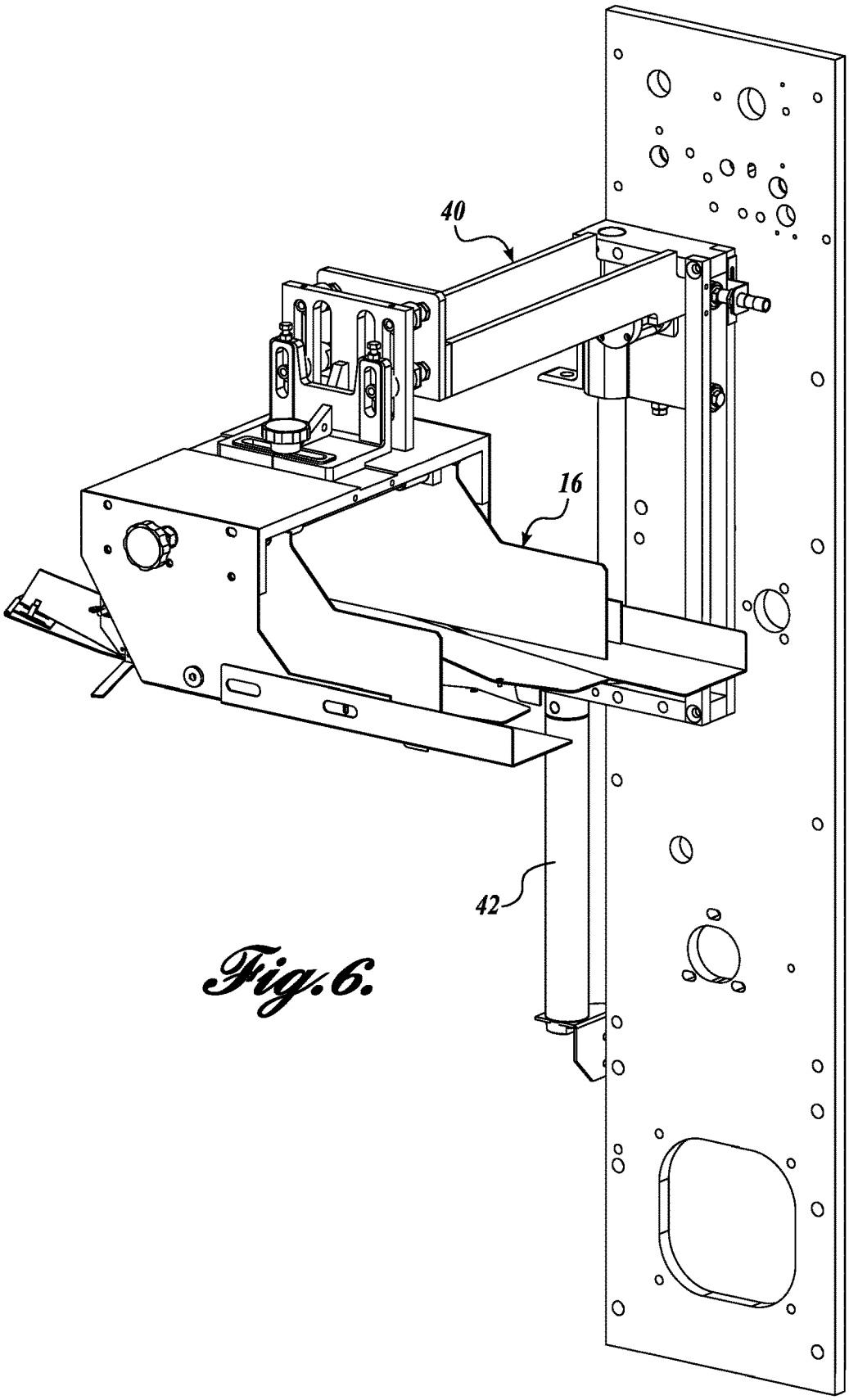
FIG. 6 is a diagrammatic top perspective of one component of the modified machine of FIG. 4 and FIG. 5, namely a lift carriage and actuator for a wrapper forming box.

With reference to FIG. 6, the forming box 16 in the modified wrapping machine is mounted on a vertically reciprocating carriage unit 40, the position of which is controlled by a fluid pressure jack 42. This assembly is mounted on the frame of the wrapping machine. For the wrapping configuration, the forming box is lowered and held in the usual bottom stationary position, but for pass-through operation the forming box is raised and held in the raised position.

Figure 8:
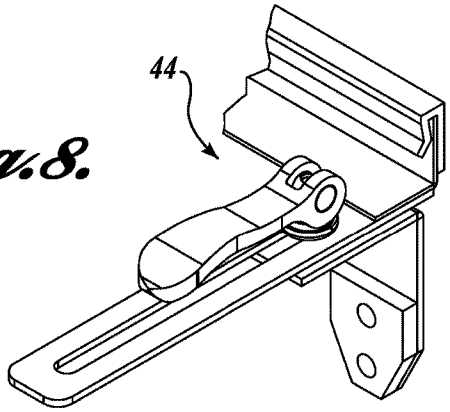
FIG. 8 is a fragmentary detail top perspective of a component for securing such slide deck.
Figure 7:
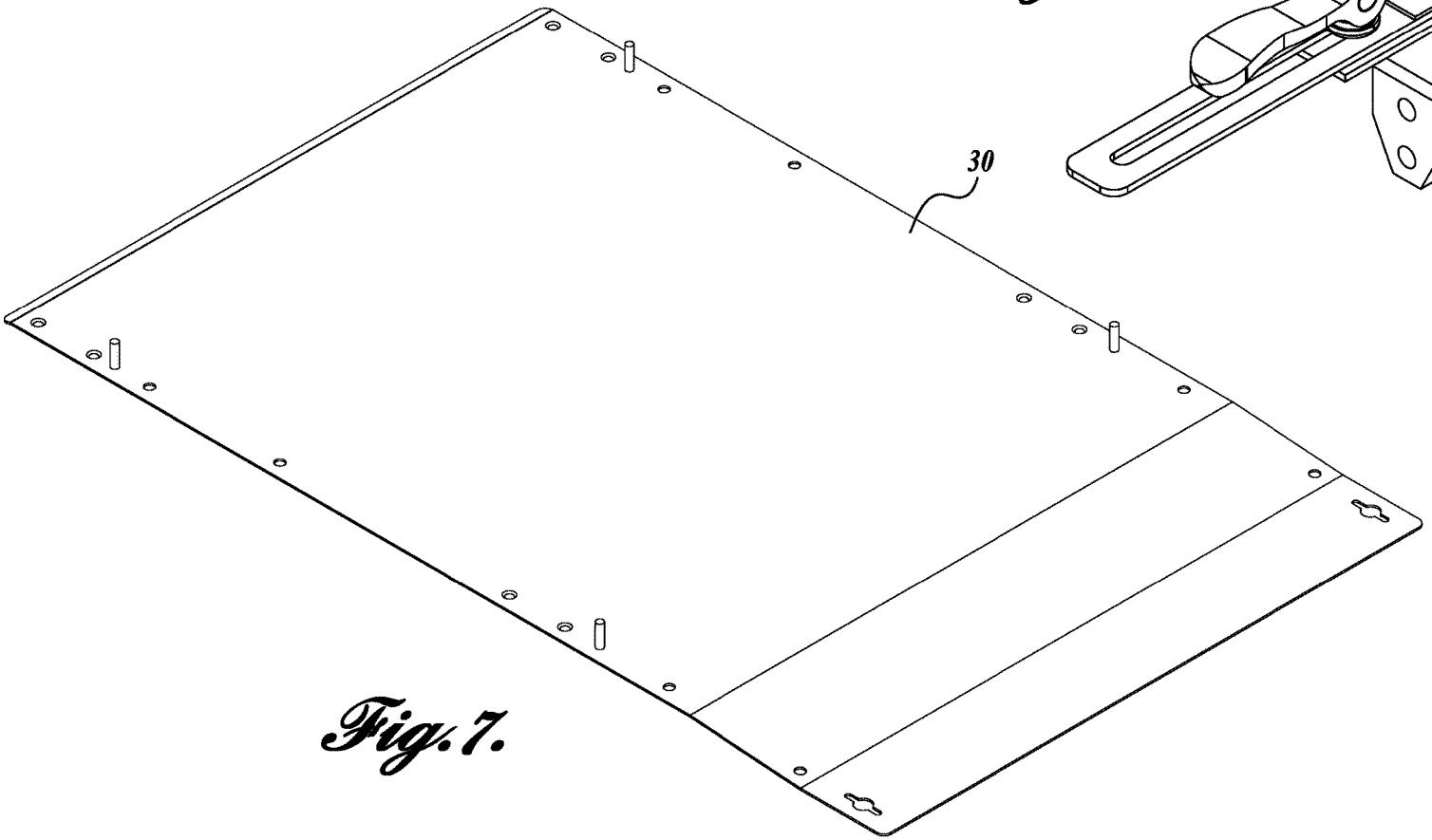
FIG. 7 is a diagrammatic top perspective of another component of the modified machine of FIG. 4 and FIG. 5, namely, a slide deck usable in a central portion of the feed path of the machine.
Figure 9:
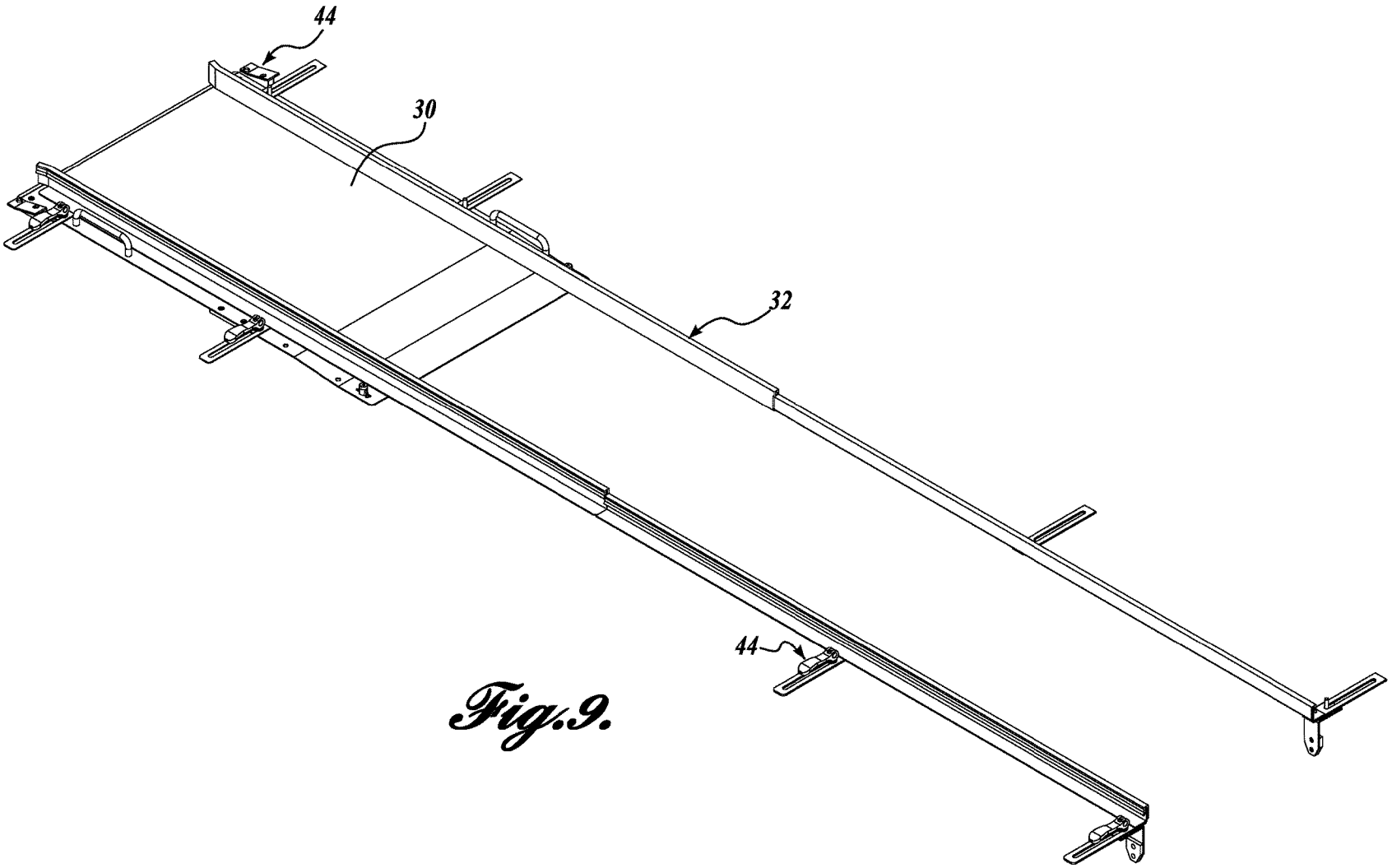
FIG. 9 is a diagrammatic top perspective of the slide deck and an associated guiderail assembly used with the slide deck in the modified bread wrapping machine.

FIG. 7 illustrates the transfer deck 30 which can be inserted downward over the wrapper pinch rolls and quickly secured in position, such as by cam locks 44 of the general type shown in FIG. 8. FIG. 9 illustrates the guiderail assembly 32 provided for smooth guided movement of the unwrapped bread loaves as they pass through the inoperative sealing area of the machine. With reference to FIG. 4, preferably the guiderails extend all the way from the outfeed area of the conventional infeed conveyor 14, under the raised forming box 16 and past the inoperative sealer unit 24, to the conventional outfeed conveyor 26.

Figure 10:
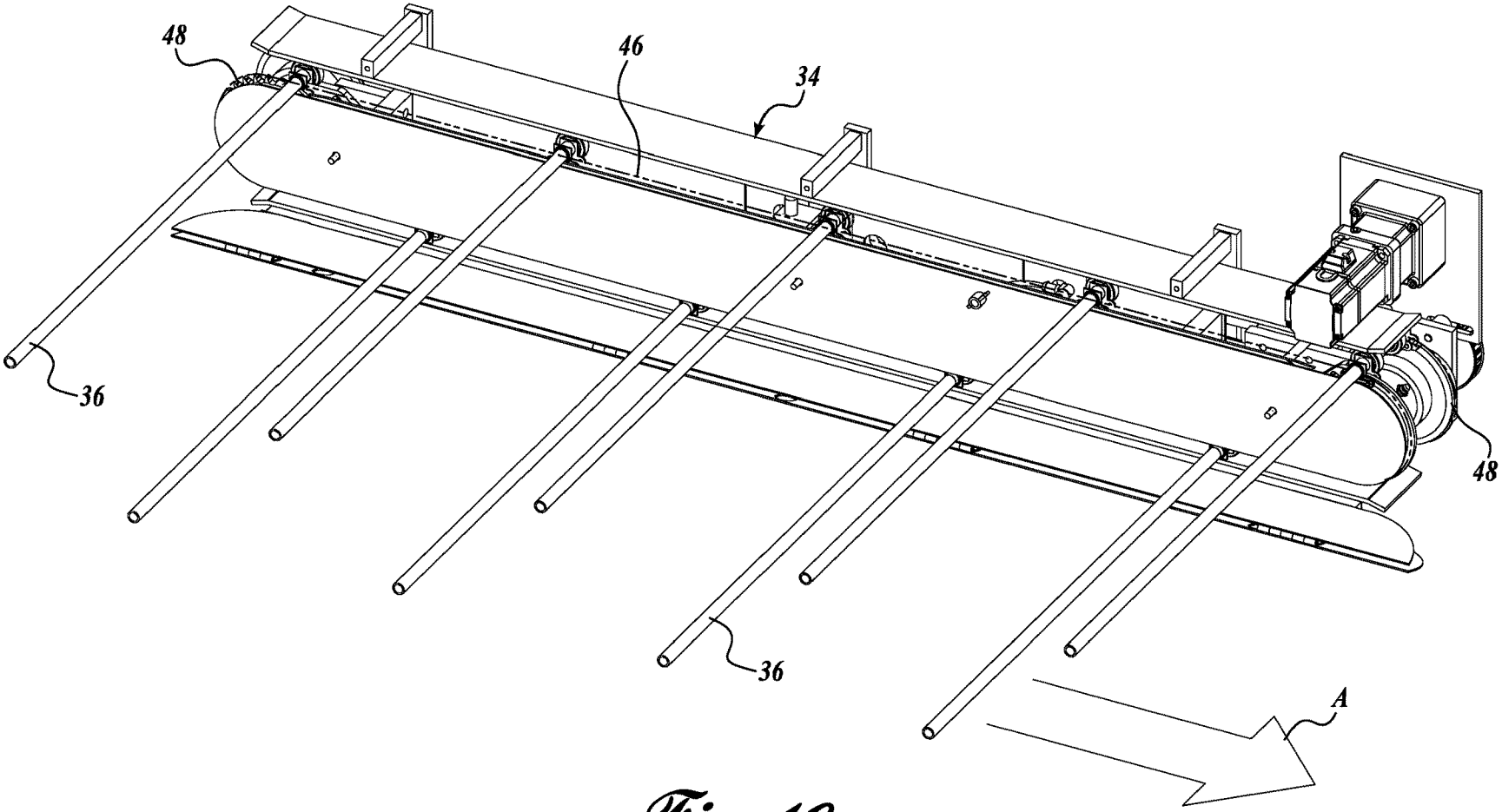
FIG. 10 is a diagrammatic top perspective of another component of the modified machine of FIG. 4 and FIG. 5, namely, an alternative transfer mechanism for moving bread loaves through a central portion of the feed path of the machine.
Figure 11:
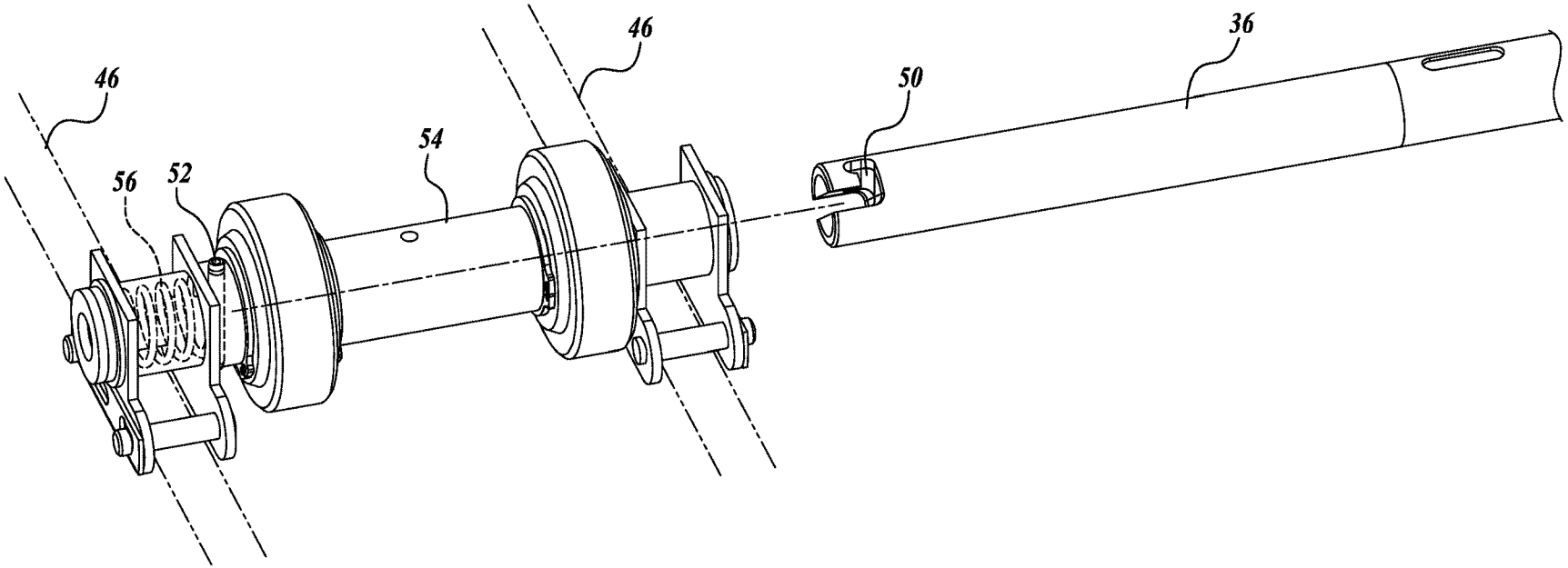
FIG. 11 is a diagrammatic detail perspective of a transverse push bar used in such alternative transfer mechanism with parts shown in exploded relationship.
Figure 12:
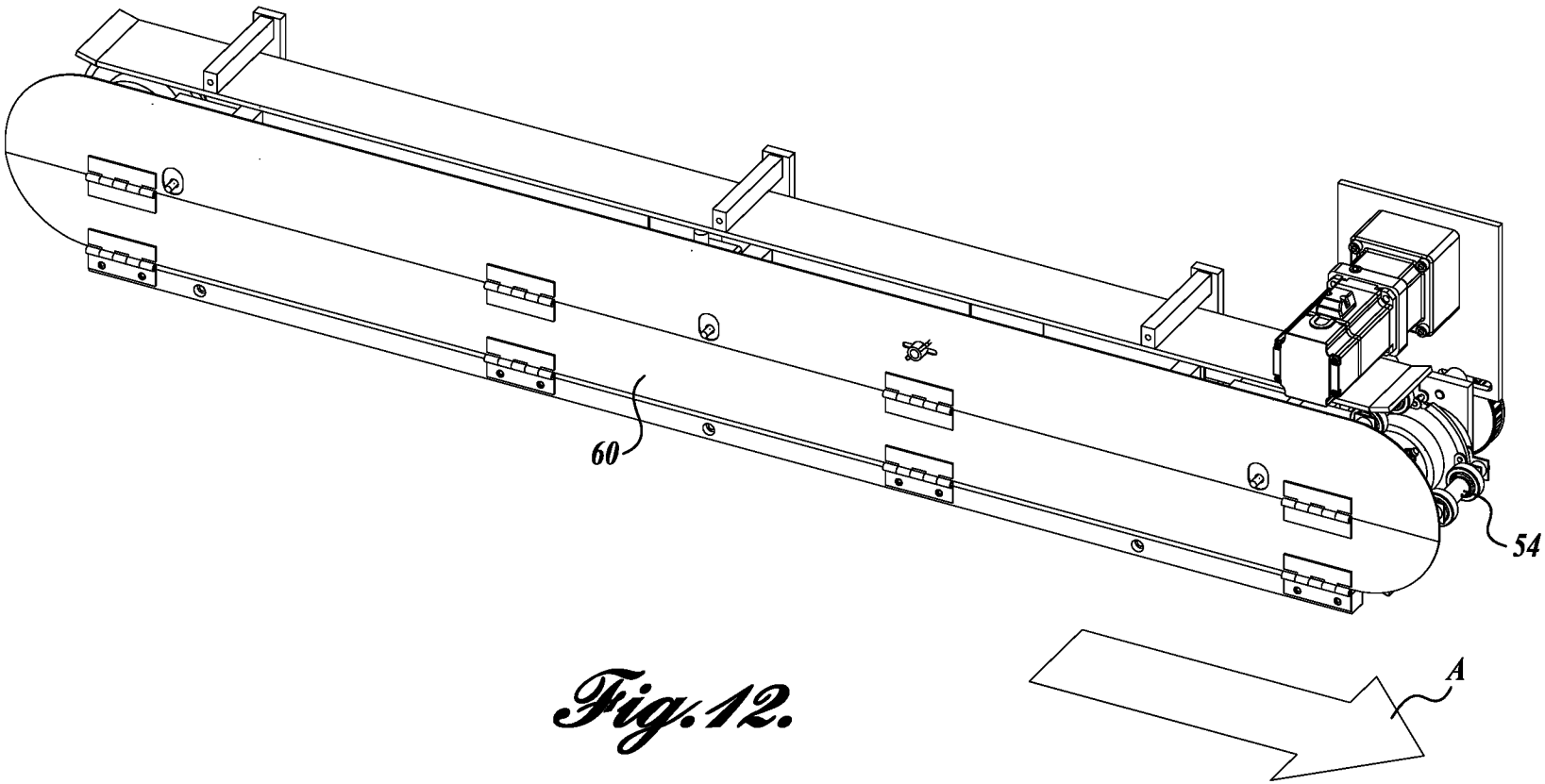
FIG. 12 is a diagrammatic top perspective of another component of the transfer mechanism of FIG. 10 with parts deleted and parts in different positions.

Aspects of the pusher bar transfer assembly are seen in FIGS. 10, 11, and 12. The separate bars 36 are carried on endless chains 46 that extend around end sprockets 48 (the bars are positioned as shown in FIG. 10, and the ends are seen in FIG. 4; a single, lower downstream bar 36 is shown in FIG. 5 with the others deleted for clarity of illustration). At least one set of end sprockets is driven by a motor. The movement of the bars is timed with the infeed and outfeed conveyors such that each loaf is engaged at the back side as it is fed onto the transfer deck, moved lengthwise as the bar moves along the lower run of the endless chain, and is released onto the discharge conveyor as its bar rotates back to the upper run of the chain. For quick changeover between the different operating modes (wrapping and pass-through), the pusher bars preferably can be manually connected and disconnected from the mounting mechanism carried by the endless chains. In one embodiment, represented in FIG. 11, a manual bayonet latch mechanism is used. The inboard bar ends have contoured slots 50 that cooperate with a spring-biased, transverse prong or pin 52. Securing the bar requires only that it be shifted endwise into a mounting unit 54 carried by the chains 46, pushed to compress a retention spring 56, turned to position the prong or pin 52 in the contoured slot 50, and released.

The entire changeover can be achieved in a few minutes. When it is desired to return the wrapping machine to the wrapping configuration, the push bars 36 can be quickly and easily removed manually; the transfer deck 30 and supplemental guiderail assembly 32 similarly is easily removed, and the jack for the forming box is actuated to lower the box to the bottom position. The wrapping material is rethreaded and its feed mechanism actuated, and control for the sealing unit is turned back on. The machine then is ready for operating again in a wrapping configuration.

One possible safety feature is a mechanism that prevents the forming box from being lowered before the push rods have been removed. With reference to FIG. 12, a hinged, folding cover 60 can be provided to fit over the push bar mountings 54, but only when the push bars are removed. The closed position of the cover can be detected by a proximity switch. Similarly, a proximity switch can be provided to indicate that the forming box is in its raised position. Control circuitry can be provided to lock the forming box in the raised position until such time as the closed position of the cover is detected, whereupon the jack can be actuated to lower the forming box.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for changeover of a horizontal bread wrapping machine from a wrapping configuration to a pass-through configuration, said bread wrapping machine having a feed path for bread loaves conveyed consecutively through the bread wrapping machine, said feed path having an infeed end and an outfeed end, and the bread wrapping machine further having, in the wrapping configuration:

a feed for a wrapping material;

a forming box in the feed path at a forming box location at or near the infeed end of the feed path for receiving consecutive bread loaves and the wrapping material and shaping the wrapping material into a tube encircling the loaves;

a bottom transfer mechanism acting on the tube to convey consecutive loaves along the feed path;

which method comprises changing the bread wrapping machine to the pass-through configuration by:

(a) disabling the wrapping material feed;

(b) shifting and maintaining the forming box out of the feed path; and (c) providing a transfer component to move loaves along the feed path from the infeed end to the outfeed end separate and apart from and independent of the bottom transfer mechanism;

whereby during performance of the method of steps (a), (b) and (c) consecutive bread loaves pass through the bread wrapping machine without being wrapped.

2. The method defined in claim 1, in which the horizontal bread wrapping machine, in the wrapping configuration, includes a cutter-sealer at a cutter-sealer location at or near the outfeed end of the feed path and constructed and arranged to plunge between loaves in the tube moving along the feed path to cut and seal the wrapping material tube to form individual wrapped loaves, which method further includes disabling the cutter-sealer sufficiently so as not to interfere with passage of bread loaves past the cutter-sealer during performance of steps (a), (b), and (c).

3. The method defined in claim 2, in which step (c) includes installing a slide deck over the bottom transfer mechanism, said slide deck having a smooth upper surface forming a bottom surface of the feed path, and providing a transfer component for engaging the loaves above the slide deck and for moving the loaves along the upper surface of the slide deck by sliding movement of the loaves thereover.

4. The method defined in claim 3, in which step (c) includes installing guiderails extending along opposite sides of the feed path, longitudinally thereof, for guiding movement of the loaves along the slide deck.

5. The method defined in claim 4, in which step (c) includes moving pusher bars extending transversely of the feed path in a continuous loop above the slide deck, such loop having an upper run in which the pusher bars are moved in an upstream direction at a height above the loaves so as not to interfere with downstream movement of the loaves along the feed path and a lower run above the slide deck but in the feed path at a height to engage the loaves and move the loaves along the feed path.

6. The method defined in claim 1, in which step (c) includes installing a slide deck over the bottom transfer mechanism, said slide deck having a smooth upper surface forming a bottom surface of the feed path, and providing a transfer component for engaging the loaves above the slide deck and for moving the loaves along the upper surface of the slide deck by sliding movement of the loaves thereover.

7. The method defined in claim 1, in which step (c) includes installing guiderails extending along opposite sides of the feed path, longitudinally thereof, for guiding movement of the loaves along the slide deck.

8. The method defined in claim 7, in which step (c) includes moving pusher bars extending transversely of the feed path in a continuous loop above the slide deck, such loop having an upper run in which the pusher bars are moved in an upstream direction at a height above the loaves so as not to interfere with downstream movement of the loaves along the feed path and a lower run above the slide deck but in the feed path at a height to engage the loaves and move the loaves along the feed path.

9. The method defined in claim 1, in which step (c) includes installing a slide deck over the bottom transfer mechanism, said slide deck having a smooth upper surface forming a bottom surface of the feed path, and moving pusher bars extending transversely of the feed path in a continuous loop above the slide deck, such loop having an upper run in which the pusher bars are moved in an upstream direction at a height above the loaves so as not to interfere with downstream movement of the loaves along the feed path and a lower run above the slide deck but in the feed path at a height to engage the loaves and move the loaves along the feed path.

* * * * *